United States Patent [19]

Franz et al.

[11] Patent Number: 4,644,840

[45] Date of Patent: Feb. 24, 1987

[54] ELECTRONIC KEYBOARD MUSICAL INSTRUMENT AND A METHOD OF OPERATING THE SAME

[75] Inventors: Reinhard Franz, Emmelshausen; Wilfried Dittmar, Halsenbach, both of Fed. Rep. of Germany; Christian Scheidegger, Buchs, Switzerland; Roland Fröhlich, Leiningen, Fed. Rep. of Germany

[73] Assignee: Franz Reinhard, Emnmelshausen, Fed. Rep. of Germany

[21] Appl. No.: 612,201

[22] Filed: May 21, 1984

[30] Foreign Application Priority Data

May 21, 1983 [DE] Fed. Rep. of Germany ..... 3318667

[51] Int. Cl.[4] ..... G10H 7/00

[52] U.S. Cl. ..... 84/1.01; 84/1.03; 84/115

[58] Field of Search ..... 84/1.01, 115, 1.03

[56] References Cited

U.S. PATENT DOCUMENTS

| | | | |
|---|---|---|---|
| 4,412,470 | 11/1983 | Jones | 84/115 |
| 4,502,359 | 3/1985 | Sano | 84/1.01 |
| 4,522,099 | 6/1985 | Melsheimer | 84/1.01 |

*Primary Examiner*—William M. Shoop, Jr.
*Assistant Examiner*—Sharon D. Logan
*Attorney, Agent, or Firm*—Peter K. Kontler

[57] ABSTRACT

An electronic keyboard musical instrument is operated by a main system computer in a manner dependent on the settings of input elements. A plurality of tone modules are used, each of which comprises a subsystem computer including a subsystem bus, a memory and a microprocessor. Data is exchanged between the main system computer and a subsystem computer through a bus switch which alternately connects the subsystem memory with the main system bus and the subsystem bus. This allows for an effectively "real time" exchange of data between the main system and the subsystem.

11 Claims, 5 Drawing Figures

1
2
PAN 1
PAN 2
PoT
OM
UM
PD
PB
HB
MC
ROM
CPU
RAM
3
V1
V2
V3
E1
E2
E3
D
IF
A
AB
4
5
C
L2
L1
KH

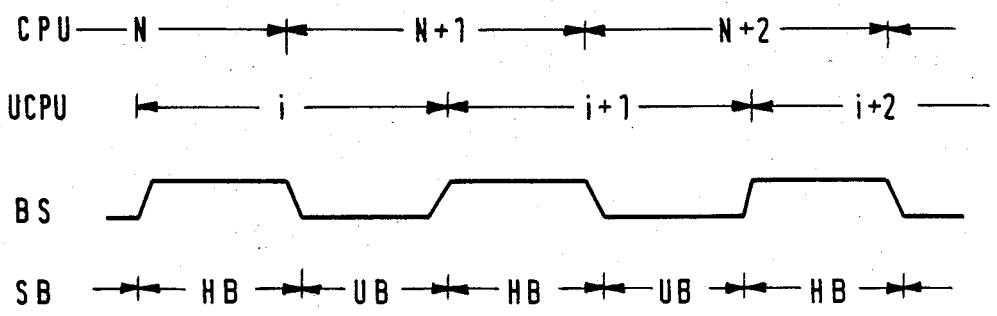
Fig.3
Fig.4
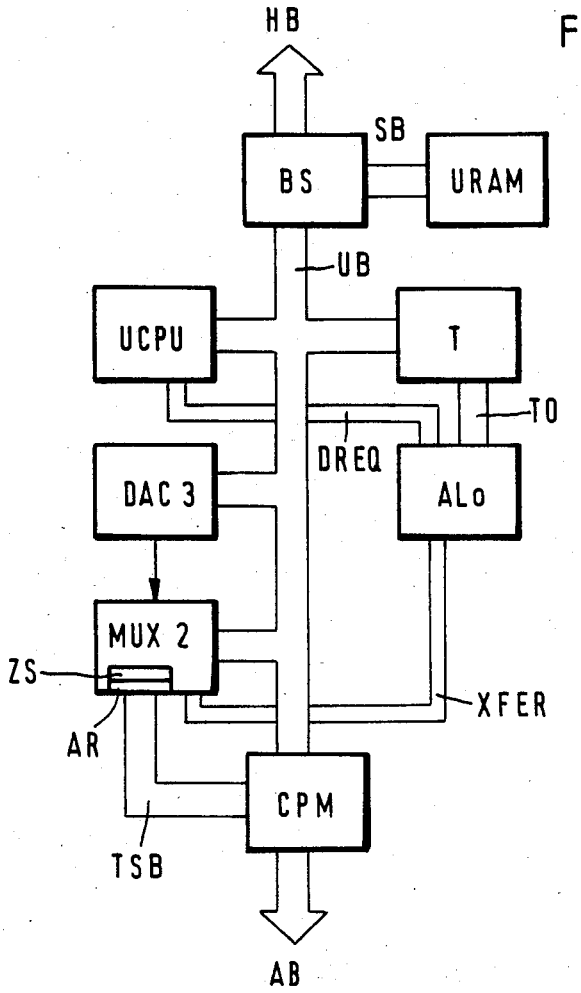

ELECTRONIC KEYBOARD MUSICAL INSTRUMENT AND A METHOD OF OPERATING THE SAME

FIELD OF THE INVENTION

This invention relates to an electronic keyboard musical instrument using input elements such as tone generating keys and digital and/or analog servicing elements, with a main system computer.

BACKGROUND OF THE INVENTION

A conventional electronic keyboard musical instrument includes a main system computer having a main system bus formed with data, address and control conductors, a main memory and a microprocessor, and at least one tone generating module. Each tone module generates a tone signal of one tone by combining, in a point-like fashion, digital values stored in a memory. Such digital values are stored in the main system data memory in the form of a table or are generated on the basis of a computation by the main system computer. Any modification of the input data leads practically immediately to a change of the contents of the memory and hence to an alteration of the tone signal. However, if several tones are present, the data memory is very large and the operating speed of the microprocessor is not sufficient to generate all of the tones needed to satisfy the acoustical requirements.

SUMMARY OF THE INVENTION

It is an object of the invention to provide an electronic keyboard musical instrument of the aforedescribed type using a main system computer comprising a main system bus, a main memory and a microprocessor and wherein the main system operates even if several tones or tone signals are present at the same time while being capable of immediate response to changes of input data.

In accordance with the invention, this object is accomplished with a tone module that is a subsystem formed with a subsystem computer, a subsystem memory, a subsystem microprocessor and a subsystem bus having data, address and control conductors. The subsystem is to coupled to the main system that data between the main system and the subsystem is exchanged through a bus switch which alternately connects the subsystem memory with the main system bus and the subsystem bus.

The inclusion of the subsystem computer effectively relieves the task of the main system computer. The main system computer is merely required to compute new parameters for a corresponding tone only in the event of a change of input data and to transfer such new parameters to the subsystem memory by way of the bus switch. Consequently, the main system computer is made available and is capable of performing other tasks, such as a cyclical monitoring and addressing of peripheral units.

The additional cost for the subsystem computer is relatively small because neither the microprocessor nor the memory of the subsystem computer are expected to perform substantial tasks. The bus switch, which alternately connects the subsystem memory with the main system bus and the subsystem bus, allows in effect a practically continuous exchange of data between the main system and the subsystem. This enables changes of input data identified by the main system to be transmitted to the subsystem and processed by the latter in practically real time.

It is preferred to design the bus switch for bidirectional exchange of data. This ensures that the main system can receive signals back from the tone module, a feature that is desirable for many types of operations.

In accordance with a preferred embodiment, the bus switch and the subsystem memory are so selected that each can be operated at twice the pulse frequency of the main system microprocessor. This permits the main system bus to be connected to the subsystem memory and the latter to the subsystem bus during each time cycle pulse of the main system microprocessor. As a result, an exchange of data can take place between the main system and a subsystem during each cycle of the main system microprocessor. This can be achieved with available switches and memories capable of sufficient operating speeds that exceed that of the main microprocessor being used.

The system flexibility can be enhanced and the system in effect simplified by using a subsystem memory which consists exclusively of RAM memory regions. This renders it possible to not only transmit parameters for tone signals from the main system to the subsystem but to also transfer the corresponding tone control program from the main system into the subsystem memory.

It is advantageous to provide the tone module with outputs for several tones all of which are generated by, and thus are dependent upon, the same subsystem computer. This further reduces the cost because it is not necessary to provide a discrete subsystem computer for each tone.

A method of operating an electronic keyboard musical instrument in accordance with the invention is characterized in that the main system microprocessor and the subsystem microprocessor are operated at the same pulse frequency but effectively offset in phase by a portion of the cycle time. The offset may be so selected that during one half of the cycle time of the main system microprocessor the bus switch connects the subsystem memory with the main system bus and during the other half of the cycle time the subsystem memory is connected to the subsystem microprocessor. Due to such staggered mode of operation of the two microprocessors, it is possible for the subsystem to process data from the main system with a delay of merely one-half of a cycle time.

In view of the bidirectional exchange of data, it is also possible to send signals back from the tone module to the main system. For example, the operation is preferably so conducted that for each tone to be generated there is also used an "occupied" signal. This signal serves to weigh or identify the momentary significance of each tone in the overall tone pattern. Such weighing can be done by assigning values to the occupied signal whose magnitudes then represent such significance. The occupied signal is stored in the subsystem memory for each and every tone to be generated. When necessary, such as when a significant tone is to be generated but no tone module is available, the main system computer compares all "occupied" signals and determines which tone has the weakest "occupied" signal. The fresh tone requested by the instrument player is then generated, even though all the tone modules are still occupied, by terminating that tone which, at that time in the overall tone pattern, has the least significance and whose termination thus is least likely to be noticed. The fresh tone replaces the terminated tone.

In the simplest case, an "occupied" signal can be derived from the intensity levels of the tone signals generated by the tone module.

With a tone module in accordance with the invention, it is advantageous to transfer all of the information which is requried for the generation of a tone from the main system computer via the bus switch into the subsystem memory after the actuation of a tone selecting key. In this manner, it is possible to conform the tone outputs of the subsystem to the momentary register at the instant of tone selection by other corresponding tone selecting keys irrespective of whether these keys are in the upper manual, lower manual, or are from a pedal or from an accompanying automaton. This ensures optimal utilization of the tones. Furthermore, a new tone can be conveniently added for each of successively actuated keys.

It is further possible to transmit, during tone transmission by the subsystem, tone altering parameters generated by the main system computer. These tone altering parameters are applied via the bus switch into the subsystem memory. An instrument operator can thus make changes or alterations of a tone such as its intensity, its frequency or other characteristics during the emission of tones.

These and other advantages and objects of the invention can be understood from the following detailed description of several embodiments which are described with reference to the drawings.

BRIEF DESCRIPTION OF DRAWINGS

FIG. 3 is a timing diagram of the mode of operation of a bus switch used in accordance with the invention, FIG. 4 is a block diagram of another tone module of this invention.

DETAILED DESCRIPTION OF DRAWINGS

Figure 1:
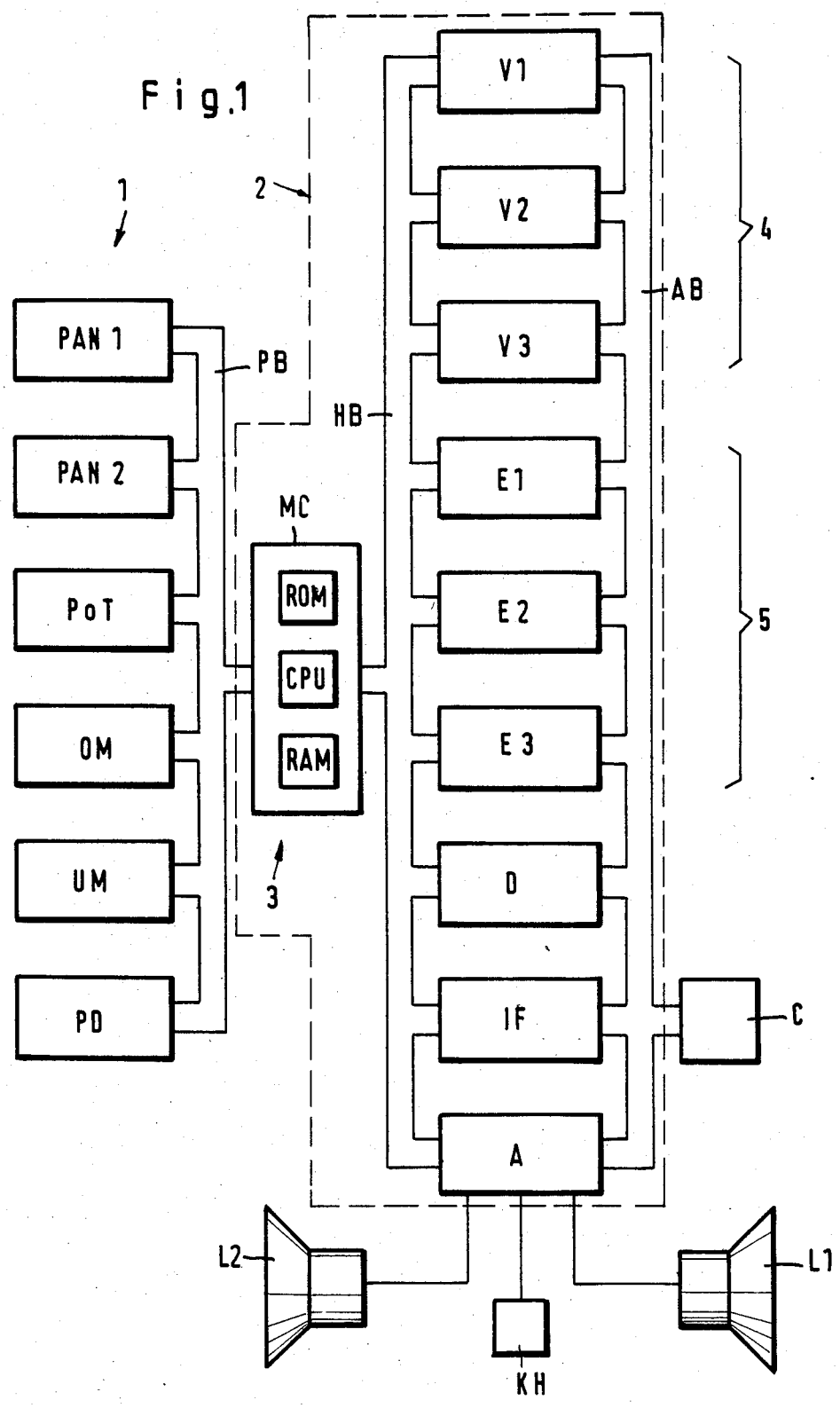
FIG. 1 is a block diagram of a keyboard musical instrument in accordance with the invention.

FIG. 1 shows an electronic musical instrument in the form of an organ. It comprises a peripheral portion 1 composed of units which are located generally at the front of the organ. The instrument further includes a functional part 2 which is installed essentially in the interior of the organ housing. The peripheral portion 1 of this embodiment comprises the following units:

A field of actuators and displays PAN1 which includes actuating keys and corresponding indicating elements for the operation of the organ, e.g., register switches for turning filter groups, effects, tone channels and the like on or off.

A field of actuators and displays PAN 2 which includes digital input elements in the form of actuating knobs with related indicating elements and which are associated with a built-in rhythm apparatus and an accompanying automaton.

A field of actuators PoT which comprises continuously adjustable analog elements, which may be potentiometers to, for example adjust a sinusoidal drawbar tone intensity or regulate a tone level and the like.

An upper manual OM with tone release keys.

A lower manual UM with tone release keys.

A pedal PD with tone release keys.

The above-enumerated units are connected with a main system 3 by a peripheral bus PB. The main system comprises a microprocessor CPU, a program memory ROM and a data memory RAM. With assistance from the main system computer MC, the condition of input units 1 including tone generating keys, digital and analog actuating elements are cyclically monitored and the information is stored in data memory RAM. The main system computer MC also controls the indicating elements.

Main system 3 includes a main system bus HB which comprises addressing, data and control conductors, in a similar manner as peripheral bus PB. The following units of functional part 2 are connected to main system bus HB:

A tone generating unit 4 with several tone modules V1, V2 and V3.

Unit 4 generates tone signals in response to the actuation of a tone selecting key in dependency with actuated servicing elements under the control of the computer MC. The tone signals are transmitted to audio bus AB.

An effect generating group 5 composed of several effect modules E1, E2 and E3, which provide secondary treatment of tone signals generated by tone modules V1–V3.

A percussion group D, which delivers percussion audio signals to the audio bus AB.

An intersection group IF which enables bidirectional connections between the main system bus HB and the audio bus AB.

An amplifier group A which takes care of several loudspeakers L1 and L2 as well as a headset connection KH.

Furthermore, the audio bus AB is connected to a coupling device C which establishes a connection with sound carriers, e.g., cassettes.

Figure 2:
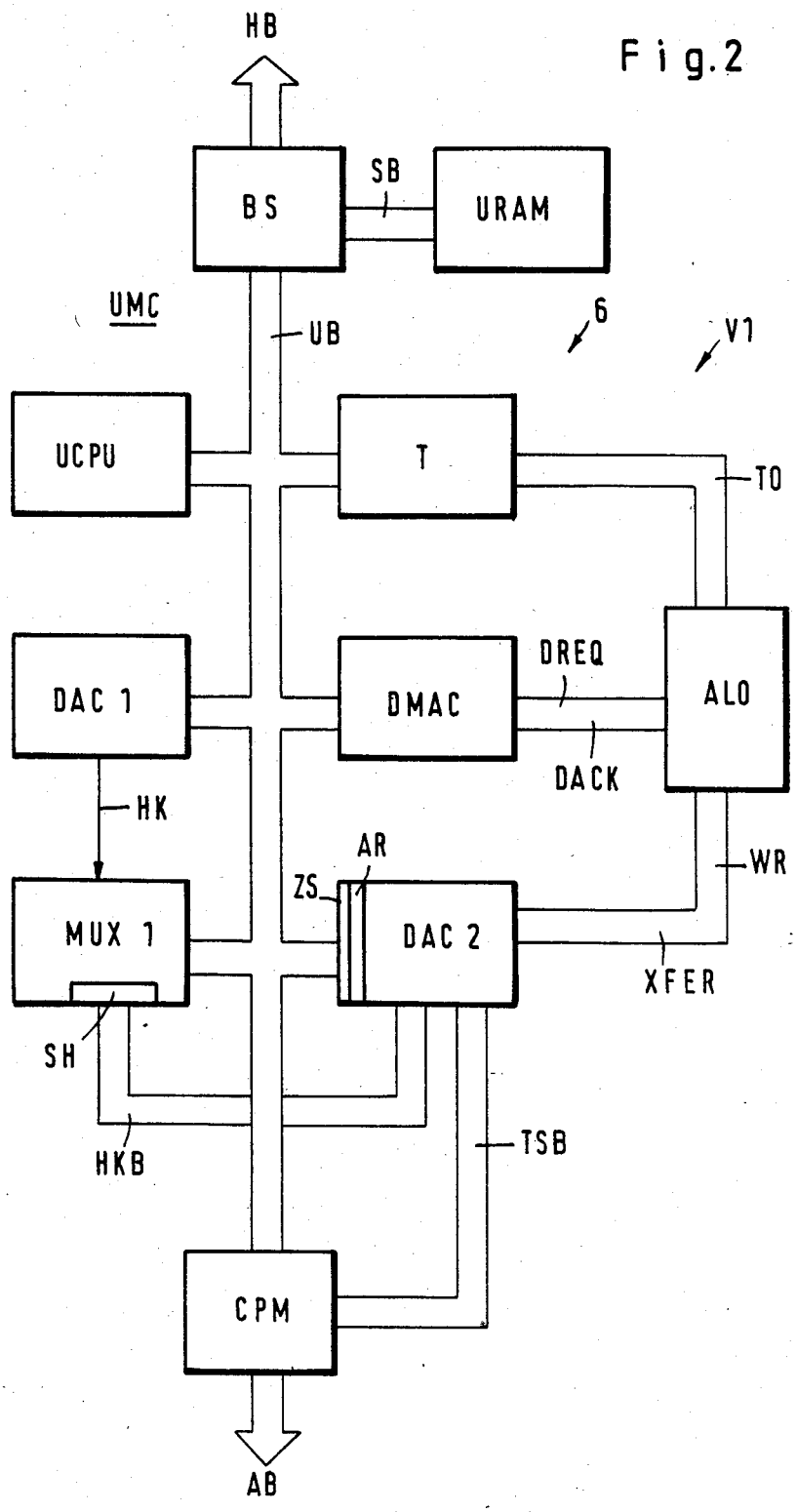
FIG. 2 is a block diagram of a tone module in accordance with the invention.

FIG. 2 shows the construction of a tone module V1 which is capable of simultaneously generating four tones, each tone being formed of two tone cures and two envelope curves. Consequently, the tone module V1 has eight output registers AR. The tones are generated by a subsystem 6 with a subsystem computer UMC which comprises a subsystem memory URAM and a subsystem microprocessor UCPU.

A bus switch BS is designed to alternately connect the memory bus SB, which leads to subsystem memory URAM, with the main system bus HB and with a subsystem bus UB. For this purpose, the speed at which bus switch BS is switched is twice that of the main system computer MC and subsystem computer UMC. In this manner, subsystem 6 can accept data from the main system 3 and the latter can accept data from the subsystem. The subsystem memory URAM stores information from the main system. This information not only includes the program used to operate the subsystem but also includes data representative of parameters for the four tones.

The subsystem bus UB interconnects the subsystem micro-processor UCPU with a multiple clock T, a memory access control circuit DMAC, a 12-bit digital to analog converter DAC1, an 8-channel multiplexer MUX 1 with eight envelope curve registers SH in the form of sample and hold networks, a double buffered 8-channel-8-bit, digital to analog converter DAC2 and an intersection matrix CPM of tone output switches.

Subsystem 6 further includes a progress control circuit ALO.

The subsystem microprocessor UCPU serves to initialize and compute envelope curves as well as to program the multiple clock T, the memory access control circuit DMAC and the intersection matrix CPM. The multiple clock T determines the frequency of the four tones and the repetition frequency of the calculation for the envelope curves. Thus, clock T transmits four time signals TO, which are independent of one another and consist, for each tone, of a series of time signals at a multiple of the tone frequency. The memory access control circuit DMAC does a repeated readout of the subsystem memory URAM for tone curve digital values for the four tones.

The digital to analog converter DAC1 provides a digital to analog conversion of the envelope curves of the four tones whose individual values are thereupon transmitted by way of a conductor HK and multiplexer MUX1 to the envelope curve registers SH. An envelope curve bus HKB applies eight different envelope curve voltages to the digital to analog converter DAC2. This converter receives individual values, with assistance from the memory access control circuit DMAC, from a table which is stored in the data memory URAM to generate eight tone curves. Such values are transmitted through eight tone channels by way of an intermediate memory ZS into digital output registers AR. The values are then multiplied by the applied envelope curve voltage and conveyed in the form of analog tone signals to the corresponding conductor of the 8-channel tone signal bus TSB. The analog tone signals are switched by the intersection matrix CPM to one or more conductors of the audio bus AB or are disconnected from such conductors.

The following mode of operation applies to FIGS. 1 and 2:

During initializing (turning on), the main system bus HB loads the program for the subsystem microprocessor UCPU into the subsystem memory URAM by way of the bus switch BS. Such program can be readily altered because it is determined by the main system. By turning off a reset signal, the subsystem microprocessor UCPU is started and initializes the units of the subsystem, such as the clock T, the intersection matrix CPM, the memory access control circuit DMAC, etc.

AS soon as a selected tone is to be generated, irrespective of whether it is initiated by an actuating key of the upper manual OM, the lower manual UM, the pedal PD or an accompanying automatic device, the main system writes parameters (for example, approximately 170 bytes) into the subsystem memory URAM by way of the bus switch BS and then transmits a "start" command into such memory. The subsystem microprocessor UCPU detects such "start" command after the next switchover by the bus switch BS and generates a corresponding tone by setting the clock T, activating the memory access control circuit DMAC, switching the intersection matrix CPM to the desired audio channel, and calculating and transmitting the envelope curves.

The selected tone time signals TO generated by clock T at a multiple of the desired frequency are transmitted to the program control circuit ALO. The latter generates a transmit command DREQ to the memory access control circuit DMAC which retrieves the digital values of a tone curve for a selected tone from the subsystem memory URAM. As soon as this has taken place, a confirmation signal DACK is generated to actuate the program control circuit ALO. In response, this transmits a write signal WR to the intermediate memory ZS of the corresponding channel of the digital to analog converter DAC2. A priority circuit in the program control circuit ALO ensures that the transmission command DREQ which belongs to the second tone curve of the selected tone and the corresponding write command WR are delayed by a working cycle. Therefore, the digital values which belong to the same time signal are entered into the intermediate memories ZS of the corresponding channels of the digital to analog converter DAC2 with a time delay.

The intermediate memory ZS is followed by a digital output register AR which receives the intermediate memory values in response to generation of "store" command XFER. This "store" command is generated simultaneously with the time signal TO. Therefore, the data which are entered with a shift in time are transferred simultaneously from the output register AR to the tone signal bus TSB in analog form. The same shift in time of the transfer commands DREQ also takes place if the time signals of two tones are to appear simultaneously.

The digital to analog converter DAC1 assembles the envelope curves for the various tone signals from the subsystem in the form of calculated digital values. This takes place in accordance with a time multiplexed procedure by which analog values are transmitted through a single channel HK for distribution by multiplexer MUX1 among the envelope curve registers SH. The envelope curve voltages in register SH serve as multiplication factors for the tone curve values which are supplied by the digital output register AR to the digital to analog converter DAC1.

Since two envelope curves and two tone curves are available for each tone, it is possible to generate highly complex tones from pairs of tone signal components. For example, it is possible to simultaneously generate sinusoidal+percussion or piano+string tones. However, it is also possible to generate variable sounds, for example, a guitar with strings tone+the effect of a plucked plectrum or, in the case of a pan flute, a sinusoidal tone+an air-rushing sound, or a suspension of sound by amplitude modulation of tone components in opposite directions.

If all tones of all of the tone modules are being produced but it is desired that a new tone be generated, one of the then produced tones must be terminated. For this purpose, the subsystem microprocessor writes an "occupied" signal for each tone into the subsystem memory URAM from which such signal can be called by the main system microprocessor CPU. The "occupied" signal also represents a value that corresponds to the momentary intensity of the tone and thus indicates the significance of the tone in the overall tone pattern. If the tone is a percussion tone, it evanesces by itself and the subsystem reports this by transmitting a zero "occupied" signal.

When a fresh tone is to be transmitted, the main system can, by addressing the location for the "occupied" signals of all of the subsystems, search for a less than maximum intensity or incompletely occupied tone module or, if all the tones are occupied at such time, locate the one with the weakest "occupied" signal and transmit a "terminate" signal therefor. The subsystem microprocessor UCPU reads such "terminate" command and disconnects or terminates the tone whereupon the "occupied" signal is converted into a zero signal. The main system is then free to start a fresh tone using the part of the tone module for which a tone was terminated.

If a tone signal is to be turned off, the main system computer ascertains whether or not such tone signal is still present in the subsystem, i.e., that it is not percussive and was not stopped as yet or has not yet faded out (died away). If necessary, the main system transmits a "realease" command for such tone to the subsystem memory URAM. The subsystem then shifts to a "release" phase for the calculation of envelope curves. Such release phase is shorter or longer depending upon the nature of the envelope curve. The subsystem reports that the particular tone is available by transmitting a zero "occupied" signal when the envelope curve has completely died out.

The main system also transmits, to certain addresses of the subsystem memories URAM, tone intensities, slalom adjustments and, if necessary, other variable parameters for the tones which are being generated at such times.

The tone output switches which together constitute the intersection matrix CPM serve to switch the tones, depending on their nature, to certain secondary processing channels so that a retention can take place in the effect units E1–E3 or to disconnect the tones from the audio bus AB conductors in order to suppress undesirable noise signals when the tone is not occupied.

The mode of operation of the bus switch BS is shown in FIG. 3. The topmost line shows the cycles N, N+1, N+2 . . . of the main system microprocessor CPU. The second line shows the cycles i, i+1, i+2 . . . of the subsystem microprocessor UCPU. The third line shows a switching signal representative of the switching condition of the bus switch BS. The fourth line indicates the duration of the connection between the memory bus SB with the main system bus HB and the subsystem bus UB. The memory bus SB is always connected with the corresponding bus of the main system 2 during the second half of the corresponding computer cycle. In this manner, each of the microprocessors CPU and UCPU can read the subsystem memory URAM and/or store signals therein as if it were normally connected with the corresponding bus. Since the operation of the subsystem memory URAM is faster than that of the microprocessors, it is permissible that the memory URAM be connected with the selected microprocessor only during a fraction of the interval of a cycle.

In the embodiment of FIG. 4, similar parts are denoted by reference numerals which are also used in FIG. 2. The basic difference is that the program control circuit ALO acts directly upon the subsystem microprocessor UCPU and, when receiving a transmit signal DREQ, interrupts the background program of this microprocessor and starts a transfer program. In addition, the tone curves and the envelope curves are not formed separately but rather the digital values for the tone signal are ascertained by calculation and transmitted into a single channel digital to analog converter DAC3. The outputs of the multiplexer MUX2 which follows DAC3, therefore, can be applied directly to the output registers AR which are connected with the intersection matrix CPM by way of the tone signal bus TSB. The output register AR is preceded by an intermediate memory ZS which, in response to the appearance of a "store" signal XFER, at the time of a time signal TO, transmits analog values, which belong to the same tone, to the output register AR even if these values were previously sequentially processed one after the other in digital to analog converter DAC3.

Figure 5:
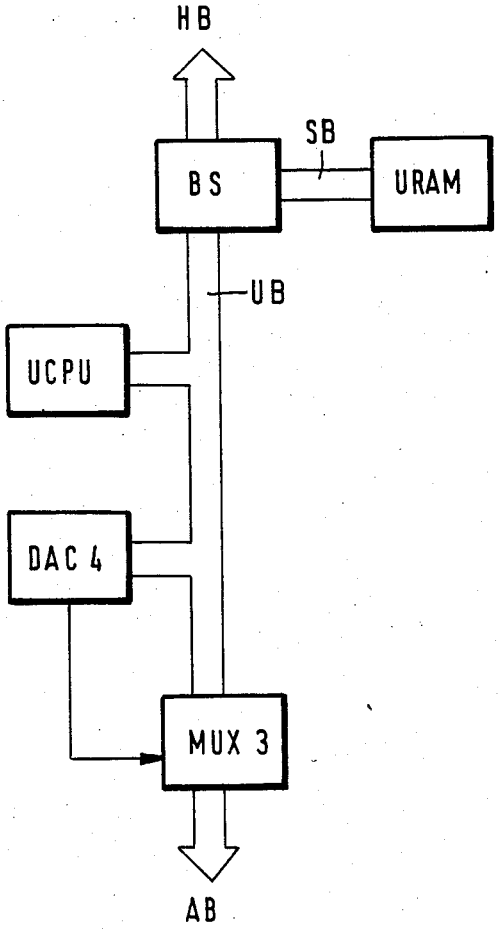
FIG. 5 is a block diagram of a modified tone module in accordance with the invention.

FIG. 5 shows a tone module which is designed for a single tone. Here again, the values of tone signals are calculated after merger of tone curves and envelope curves, and such signals are assembled into a tone signal in the digital to analog converter DAC4. The thus obtained tone signal can be transmitted to one of several audio bus conductors by way of an analog multiplexer MUX3.

Commercially available components were used for all of the units such as main system microprocessor CPU, program memory ROM, data memory RAM, subsystem microprocessor UCPU, subsystem memory URAM, bus switch BS, clock T, memory access control switch DMAC, program control circuit ALO, multiplexer MUX1, multiplexer MUX2, multiplexer MUX3, intersection matrix CPM, digital to analog converter DAC1, digital to analog converter DAC2, digital to analog converter DAC3, and digital to analog converter DAC4.

Having thus described several embodiments of the invention, its advantages can be appreciated.

What is claimed is:

1. A method of operating an electronic keyboard musical instrument with input actuating elements such as tone selecting keys comprising the steps of:

operating a main system computer having a main system bus and a microprocessor to respond to said input actuating elements, operating a subsystem computer having a subsystem bus, a subsystem memory and a microprocessor to generate tone signals in response to actuated input elements, cyclically operating the main system microprocessor and the subsystem microprocessor at the same pulse frequency but offset in phase; and coupling the subsystem memory to the main system bus during one part of the cycle time of the main system microprocessor and with the subsystem bus during another part of the cycle time.

2. The method of operating an electronic keyboard musical instrument as claimed in claim 1 and further comprising the step of storing an occupied signal whose magnitude corresponds to the momentary significance of a tone in an overall tone pattern into the subsystem memory for each tone signal generated by the subsystem computer.

3. The method of operating an electronic keyboard musical instrument as claimed in claim 2 and further including the steps of:

comparing occupied signals associated with different tone signals generated by the subsystem computer;

terminating the generation of a tone signal associated with the weakest occupied signal, and initiating a new tone signal from the network used to generate the previously terminated tone signal associated with the weakest occupied signal.

4. The method of operating an electronic keyboard musical instrument as claimed in claim 2 and further including the step of coupling all of the information which is required for the generation of a tone to the subsystem computer from the main system computer upon the actuation of a tone selecting key.

5. The method as claimed in claim 2, wherein the occupied signal is derived from the intensity of the tone signal.

6. The method according to claim 5 and further comprising the step of coupling tone altering parameters from the main system computer to the subsystem computer during the generation of a tone by the latter.

7. An electronic keyboard musical instrument with input actuating elements such as tone selecting keys comprising main system computer means including a main system memory, a main system microprocessor and a main system bus, tone module subsystem computer means for generating tone signals and being coupled to communicate with the main system computer means by way of the latter's main system bus, said tone module subsystem computer means comprising a subsystem bus, a subsystem memory and a subsystem central processor unit; and bus switch means for alternately coupling the subsystem memory to the main system bus and the subsystem bus, the bus switch means being selected to enable bidirectional flow of data between the main system computer means and said tone module subsystem computer means, and the bus switch means and the subsystem memory being selected so as to be capable of operating at a speed which is twice the pulse frequency of the main system microprocessor.

8. The keyboard musical instrument as claimed in claim 7, wherein the subsystem memory is a RAM memory.

9. An electronic keyboard musical instrument with input actuating elements such as tone selecting keys comprising main system computer means including a main system memory, a main system microprocessor and a main system bus, tone module subsystem computer means for generating tone signals and being coupled to communicate with the main system computer means by way of the latter's main system bus, said tone module subsystem computer means comprising a subsystem bus, a subsystem memory and a subsystem central processor unit, and said tone module sybsystem computer means producing a plurality of tone signals; and bus switch means for alternately coupling the subsystem memory to the main system bus and the subsystem bus.

10. The keyboard musical instrument as claimed in claim 9, wherein the bus switch means is selected to enable bidirectional flow of data between the main system computer means and said tone module subsystem computer means.

11. The keyboard musical instrument as claimed in claim 9 and including a plurality of tone module subsystem computer means.

* * * * *